US009638205B2

(12) United States Patent
Peabody et al.

(10) Patent No.: US 9,638,205 B2
(45) Date of Patent: May 2, 2017

(54) DOUBLE SEAL PUMP WITH INTEGRAL ACCUMULATOR

(71) Applicant: MP Pumps, Inc., Fraser, MI (US)

(72) Inventors: Gregory G Peabody, Shelby Township, MI (US); Kenneth W Tromley, Sterling Heights, MI (US)

(73) Assignee: MP Pumps, Inc., Fraser, MI (US)

( * ) Notice: Subject to any disclaimer, the term of this patent is extended or adjusted under 35 U.S.C. 154(b) by 344 days.

(21) Appl. No.: 14/257,486

(22) Filed: Apr. 21, 2014

(65) Prior Publication Data

US 2015/0300363 A1 Oct. 22, 2015

(51) Int. Cl.

| | |
|---|---|
| ***F01D 5/00*** | (2006.01) |
| ***F04D 29/10*** | (2006.01) |
| ***F04D 7/06*** | (2006.01) |
| ***F04D 29/12*** | (2006.01) |
| ***F04D 29/62*** | (2006.01) |

(52) U.S. Cl.

CPC ..... *F04D 29/108* (2013.01); *F04D 7/06* (2013.01); *F04D 29/128* (2013.01); *F04D 29/628* (2013.01)

(58) Field of Classification Search

CPC .... F04D 29/108; F04D 29/128; F04D 29/628; F04D 7/06

See application file for complete search history.

(56) References Cited

U.S. PATENT DOCUMENTS

| | | | | |
|---|---|---|---|---|
| 3,513,942 | A * | 5/1970 | Sato | F04D 13/06 184/6 |
| 3,746,472 | A * | 7/1973 | Rupp | F04D 15/0263 277/320 |
| 4,474,529 | A * | 10/1984 | Kinsey | F03D 3/0472 415/4.2 |
| 5,263,825 | A * | 11/1993 | Doolin | F04D 29/128 417/423.1 |
| 5,746,435 | A | 5/1998 | Arbuckle | |
| 5,789,822 | A * | 8/1998 | Calistrat | F01D 17/24 290/40 A |
| 5,803,463 | A | 9/1998 | Brooks et al. | |
| 6,422,822 | B1 * | 7/2002 | Holmes | F04D 13/083 417/13 |
| 7,001,159 | B2 * | 2/2006 | Peterson, Jr. | F04D 29/126 277/427 |
| 2011/0280714 | A1 | 11/2011 | Northrup | |

* cited by examiner

*Primary Examiner* — Jesse Bogue

(74) *Attorney, Agent, or Firm* — Woods Oviatt Gilman LLP; Katherine H. McGuire, Esq.

(57) ABSTRACT

A double seal pump assembly is provided and comprises a pump housing having an inlet and an outlet. An impeller is in communication with the inlet and outlet. The impeller includes an impeller shaft extending outwardly from the housing. The impeller shaft is adapted to engage a drive shaft of a motor. A housing adapter is mounted onto the housing at a first seal and is configured to secure the impeller to the housing. A motor adapter is mounted to the housing adapter at a second seal thereby defining a cavity therebetween. The motor adapter is configured to mount the motor and the cavity is configured to be filled with a barrier fluid. An accumulator is in fluid communication with the cavity and is adapted to hold a reserve barrier fluid so as to maintain barrier fluid volume and pressure within the cavity.

19 Claims, 6 Drawing Sheets

DOUBLE SEAL PUMP WITH INTEGRAL ACCUMULATOR

BACKGROUND OF THE INVENTION

The present invention relates to a double seal pump system, and more particularly a double seal pump system having a pressurized barrier fluid, and even more particularly to a double seal pump system having an integral accumulator for supplying reserve barrier fluid and maintaining the pressure of the pressurized barrier fluid.

SUMMARY OF THE INVENTION

A mechanical seal is generally utilized in pumps which have a rotating shaft that extends outside of the pump housing. The mechanical seal ideally prevents the process fluid being pumped from leaking outside the pump housing where the shaft exits the housing. The mechanical seal is generally comprised of a hard material, such as silicon carbide, within the pump housing. A softer material, such as carbon or graphite, generally rotates along with the shaft and is mated against the stationary hard material to form the seal. A biasing member, such as a spring, is used to bias the two materials against one another to maintain contact between the surfaces of the seals as the soft material wears through use. As heat and friction are generated by the rotating soft seal against the hard seal surface, a lubricant is usually employed to alleviate heat build-up, decrease seal wear and increase seal lifetime. Depending upon the fluid being pumped, a portion of this fluid may be recirculated across the seal so as to lubricate the seal. For obvious reasons, this approach is not well suited when pumping abrasive fluids as these fluids would prematurely wear the seals. Using the process fluid as a lubricant will also invariably lead to leaking of the fluid into the environment. As a result, such systems are not readily amendable for pumping hazardous, toxic or flammable fluids.

For applications dealing with hazardous, toxic, flammable or abrasive fluids, a second containment seal may encapsulate the mechanical seal in a so-called "double seal" arrangement. In a double seal pump, the impeller shaft passes through successive walls of the pump housing. A cavity is situated between the walls and is configured to trap a barrier fluid. Mechanical seals envelop the impeller shaft within the cavity and, under proper operating conditions, prevent process fluid from entering the cavity or otherwise escaping into the environment. In a double seal pump, the barrier fluid within the cavity is typically under pressure and lubricates the mechanical seals. Should a mechanical seal leak or outright fail, barrier fluid will be forced into the process fluid rather than the process fluid leaking outside of the pump containment and into to environment. As such, double seal pumps are of particular use when the fluid being pumped is abrasive, hazardous, toxic or flammable. Ideally, the barrier fluid is selected to be a neutral or non-reactant fluid to minimize any adverse effects should the barrier fluid combine, mix or otherwise come in contact with the process fluid. A typical barrier fluid may be comprised of a suitable grease. To provide the necessary pressure to the barrier fluid, as well as be a supply source for additional barrier fluid should a leak occur, current double seal pumps generally employ an externally attached accumulator. However, current systems suffer a number of significant drawbacks, such as increased cost due to additional pump system equipment and plumbing, increased possibility of leaks due to the additional system connections, and large spatial requirements to house not only the pump but also the accumulator and its associated plumbing.

The present invention addresses the above needs by providing a double seal pump wherein a barrier fluid accumulator is integrally mounted onto the body of the pump. The integral accumulator provides for numerous advantages, including a more compact pump footprint, less plumbing and associated connections/pathways susceptible to barrier fluid leaks, greater pump reliability, and decreased system cost.

In an embodiment of the present invention, a double seal pump assembly is provided with the system comprising a pump housing having an inlet and an outlet. An impeller is in communication with each of the inlet and the outlet such that a fluid entering the inlet is pumped out of the outlet. The impeller includes an integral impeller shaft extending outwardly from the housing with the impeller shaft being adapted to engage a drive shaft of a motor. A housing adapter is mounted onto the housing at a first seal with the housing adapter configured to secure the impeller to the housing. A motor adapter is mounted to the housing adapter at a second seal thereby defining a cavity therebetween. The motor adapter is configured to mount the motor and the cavity is configured to be filled with a barrier fluid. An accumulator is in fluid communication with the cavity and is adapted to hold a reserve barrier fluid so as to maintain barrier fluid volume and pressure within the cavity.

In a further embodiment of the present invention, a double seal pump assembly is provided with the system comprising a pump housing having an inlet and an outlet. A housing adapter is mounted onto the housing at a first seal. The housing adapter is configured to secure the impeller to the housing. A motor adapter is mounted to the housing adapter at a second seal thereby defining a cavity therebetween. The motor adapter is configured to mount the motor while the cavity is configured to be filled with a barrier fluid. An impeller is in communication with each of the inlet and the outlet wherein a fluid entering the inlet is pumped out of the outlet. The impeller includes an integral impeller shaft extending outwardly from the housing, the impeller shaft being adapted to engage a drive shaft of a motor. The impeller shaft passes through respective holes within the housing adapter and motor adapter. An impeller shaft seal encircles the portion of the impeller shaft situated within the cavity so as to seal the respective holes and render the cavity substantially fluid-tight. An accumulator is removably mounted to the housing adapter and is in fluid communication with the cavity. The accumulator is adapted to hold a reserve barrier fluid so as to maintain barrier fluid volume and pressure within the cavity.

DETAILED DESCRIPTION

Figure 1:
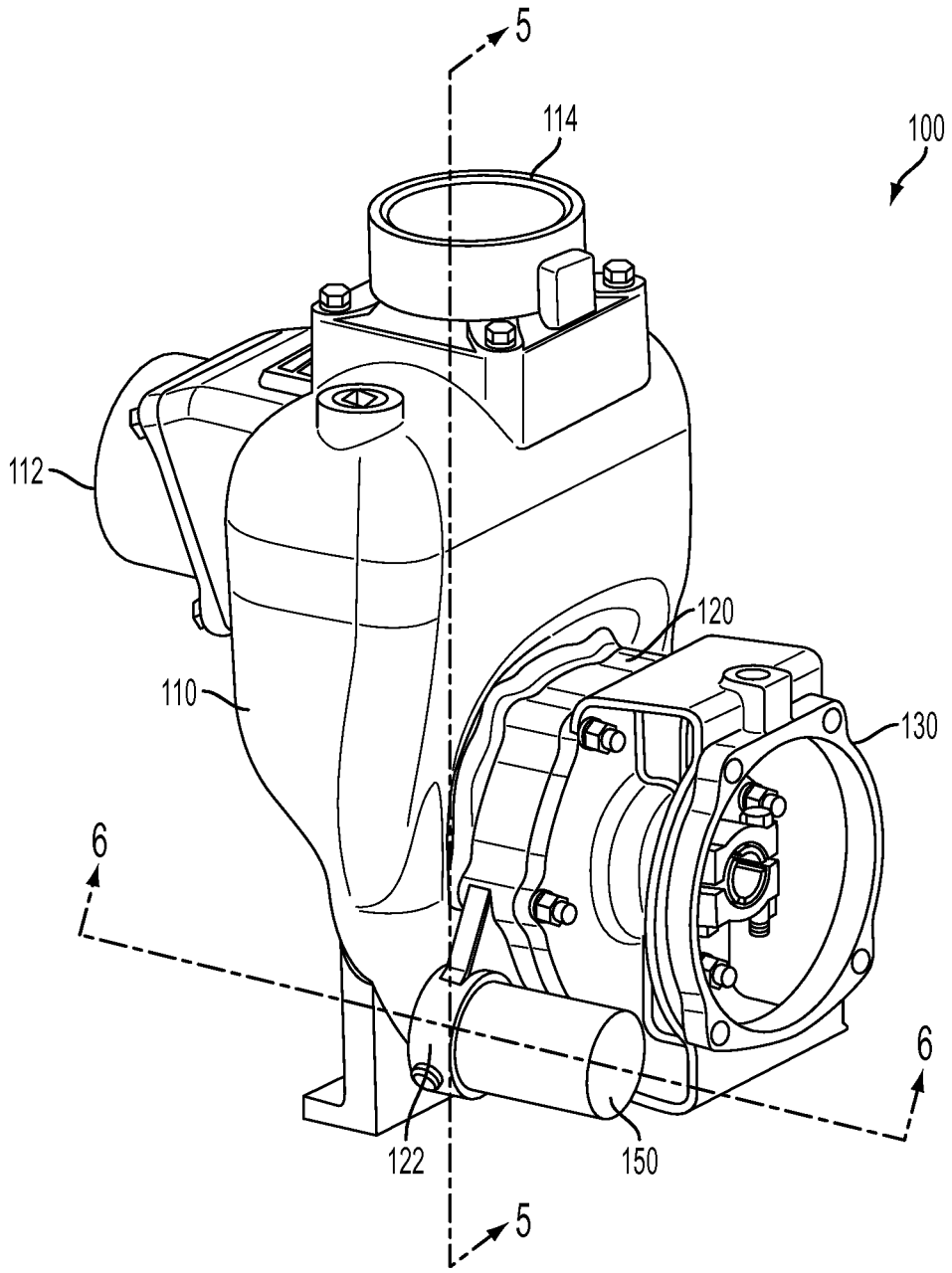
FIG. 1 is a left front perspective view of a double seal pump assembly in accordance with the present invention.
Figure 2:
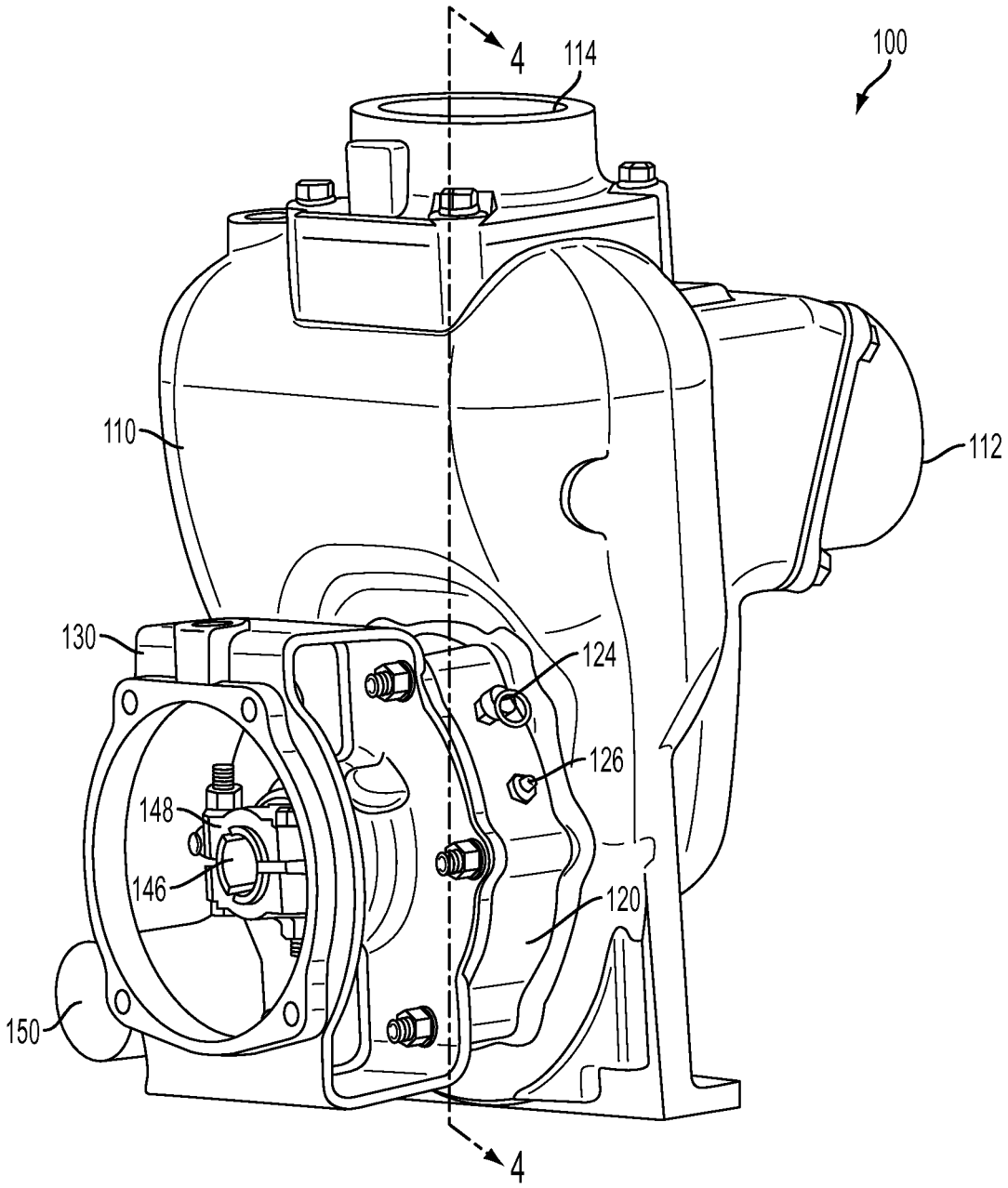
FIG. 2 is a right front perspective view of a double seal pump assembly in accordance with the present invention.
Figure 3:
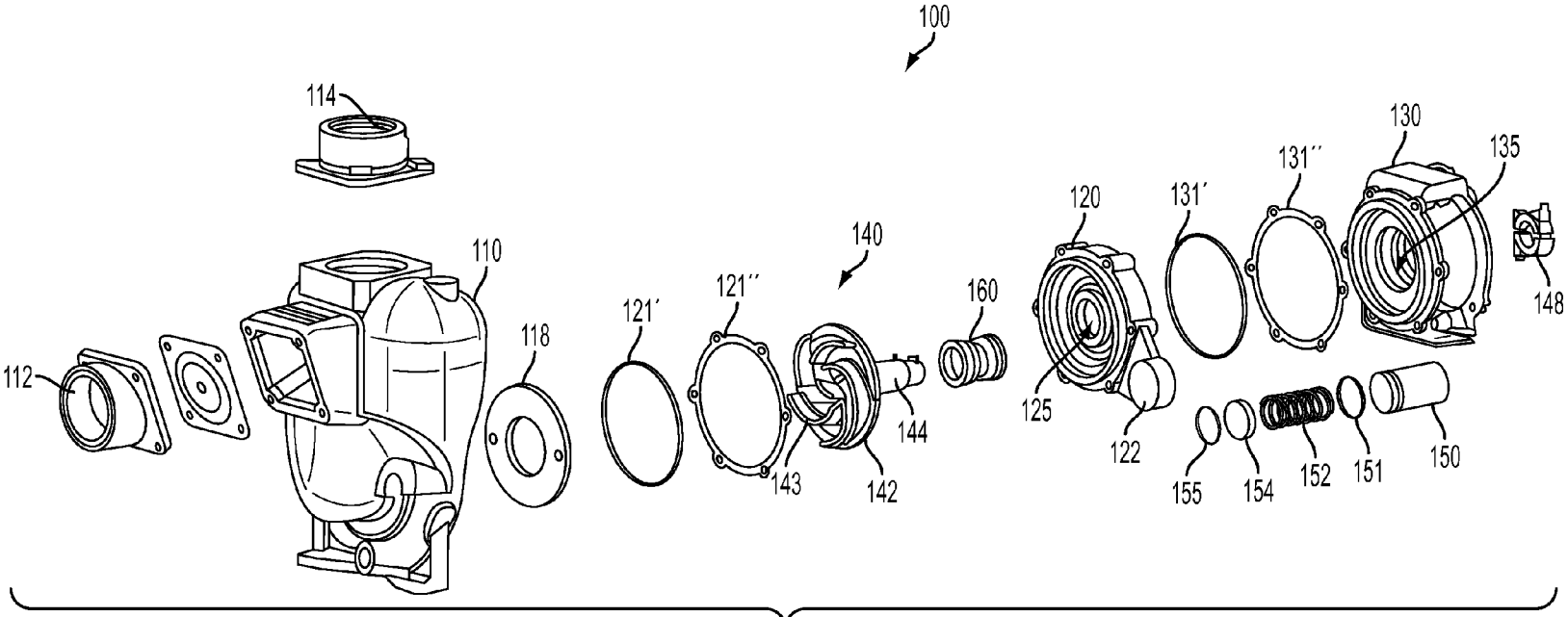
FIG. 3 is an exploded view of a double seal pump assembly in accordance with the present invention.

Referring now to the drawings, there is seen in the figures a double seal pump assembly equipped with an integral accumulator designated generally by the reference numeral 100, the assembly having a pump housing 110, housing adapter 120, motor adapter 130 and integral accumulator 150 (see FIGS. 1 and 2). Housing 110 is configured to include an inlet (such as that provided by suction flange 112) in fluid communication with an outlet (such as that provided by discharge flange 114) (see FIGS. 1-5) wherein a process fluid is introduced into the inlet and accelerated out of the outlet by action of a pump mechanism, such as that provided by an impeller 140 (see FIGS. 3 and 4). Housing adapter 120 is mounted onto housing 110 and secures impeller 140 in its proper operational location. Motor adapter 130 is mounted onto housing adapter 120 so as to define a cavity 165 therebetween, the cavity being configured to contain a barrier fluid (see FIGS. 4 and 6). As shown in FIG. 2, housing adapter 120 includes a fitting 126 for charging cavity 165 with fluid. In accordance with an embodiment of the present invention, the barrier fluid within cavity 165 is pressurized so as to prevent pumped process fluids from leaking into the environment. To prevent over-pressurization of the cavity, housing 120 may further be equipped with a pressure release valve 124.

Figure 4:
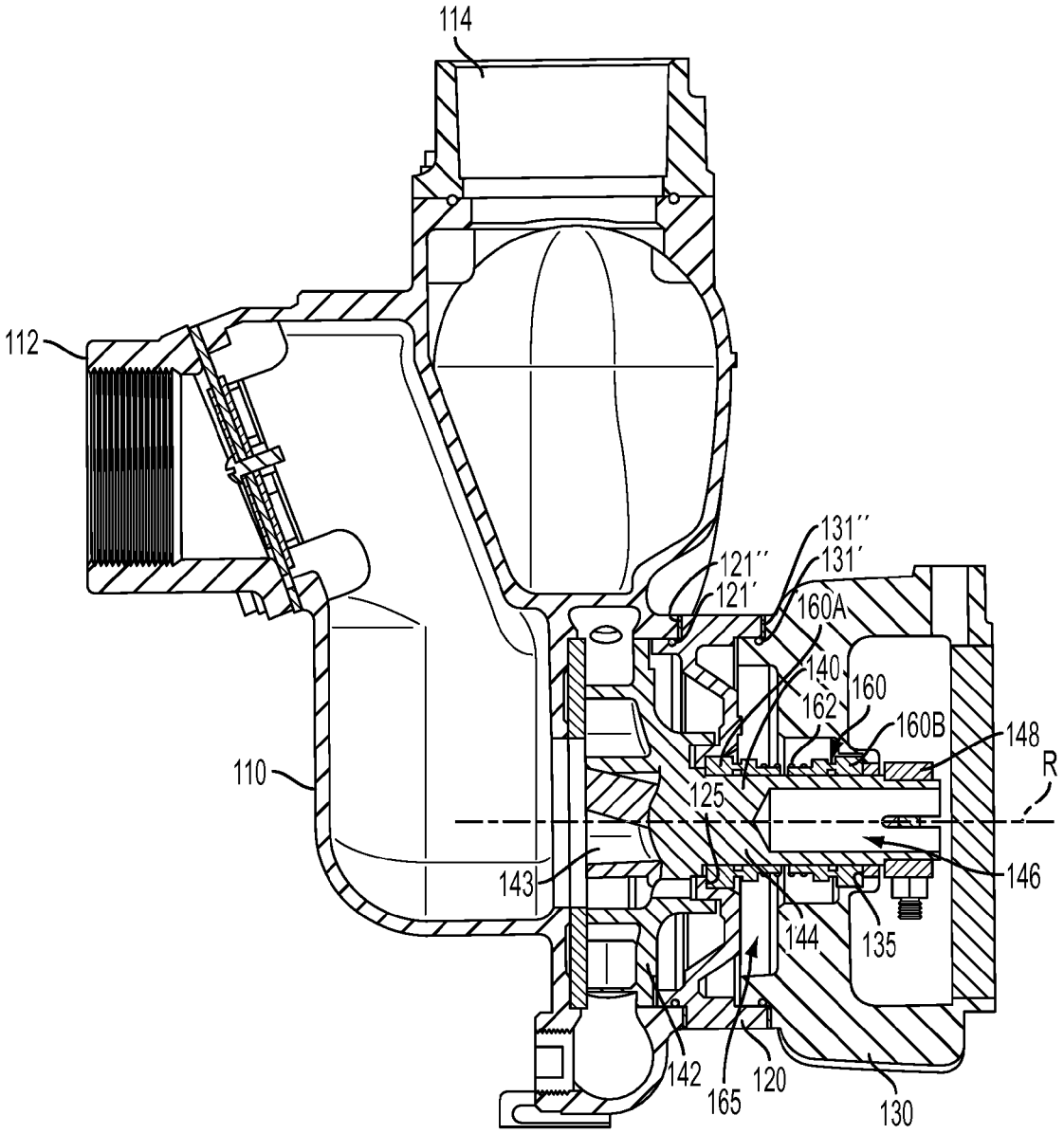
FIG. 4 is a cross section view of a double seal pump assembly in accordance with the present invention taken generally along line 4-4 in FIG. 2.
Figure 6:
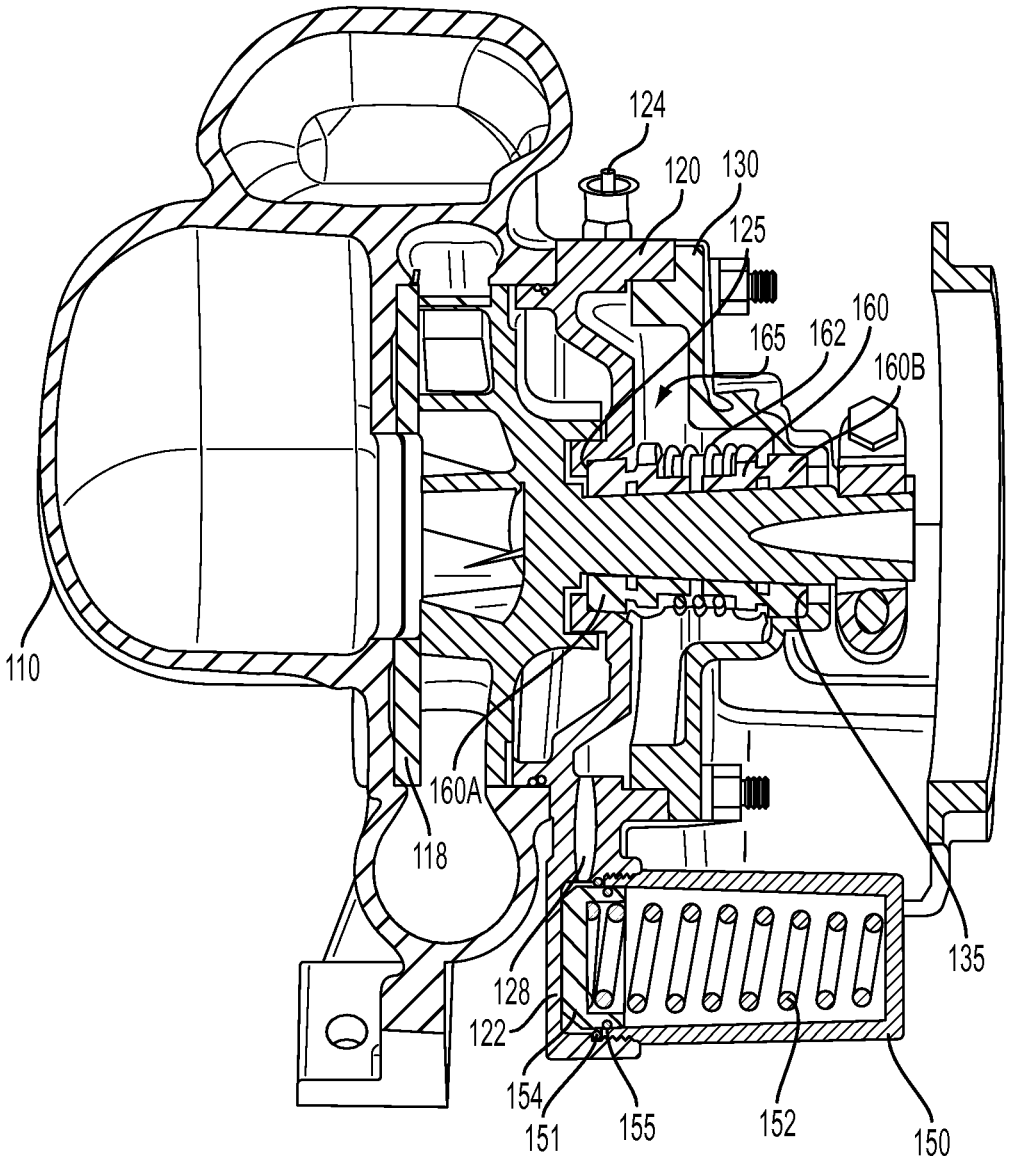
FIG. 6 is a cross section view of a double seal pump assembly in accordance with the present invention taken generally along line 6-6 in FIG. 1.

In accordance with one aspect of the present invention and as shown most clearly in FIGS. 4 and 6, the double seal pump assembly 100 includes a centrifugal pump having impeller 140 driven by an external motor (not shown) mounted onto motor adapter 130. Impeller 140 has an impeller shaft 144 extending outwardly from housing 110 and passing through respective holes 125 and 135 within impeller adapted 120 and motor adapter 130. Impeller shaft 144 includes an internal bore 146 adapted to engage with a drive shaft on the external motor (not shown). To that end, impeller shaft 144 may include a clamp assembly 148 to constrain the drive shaft within the internal bore 146. In this manner, motor driven rotation of the drive shaft serves to rotate impeller 140 about rotational axis R. The opposing end of impeller 140 has an impeller head 142 configured to include a plurality of vanes 143. Process fluid from inlet/suction flange 112 enters the impeller 140 at or near the rotational axis R where it then is accelerated by vanes 143 to exit through outlet/discharge flange 114. A replaceable wear plate 118 may be positioned between impeller head 142 and housing 110 to channel incoming process fluid to the rotational center of the impeller head 142 while also minimizing or eliminating wear to housing 110 by the rotational travel of the impeller head and its associated vanes 143.

As can be seen by the above recitation, care must be taken to prevent leakage of process fluid where the rotating impeller shaft 144 exits housing adapter 120 and motor adapter 130. This is of particular importance when the process fluid is hazardous, toxic, flammable or otherwise detrimental to the environment. To that end, the portion of impeller shaft 144 within cavity 165 is sealed by way of a seal assembly 160. Each opposing end of seal assembly 160 operates as an end face mechanical seal, with one end forming a seal against housing adapter 120 about hole 125 with the opposing end forming a seal against motor adapter 130 about hole 135. An actuating force, such as that provided by spring 162, maintains intimate contact between each of the sealing surfaces of seal assembly 160 and its respective adapter. Further actuation of the sealing surfaces against the adapters, as well as lubrication of the sealing surface, may be provided by provision of a pressurized barrier fluid resident within cavity 165. Sealing of overlapping nonmoving portions of the housing/adapters may be through respective O-rings 121/131 and/or gaskets 121'/131'. In this manner, process fluid is prevented from leaking between the mating faces of housing 110 and housing adapter 120 while barrier fluid is prevented from leaking between the mating faces of housing adapter 120 and motor adapter 130. Ideally, the pressurized barrier fluid is maintained within the cavity at a pressure sufficient such that if the seal assembly (particularly the seal between housing 110 and housing adapter 120) should fail, barrier fluid will leak into the process fluid pump stream rather than having the process fluid (especially when hazardous, toxic, etc.) leak into environment.

Figure 5:
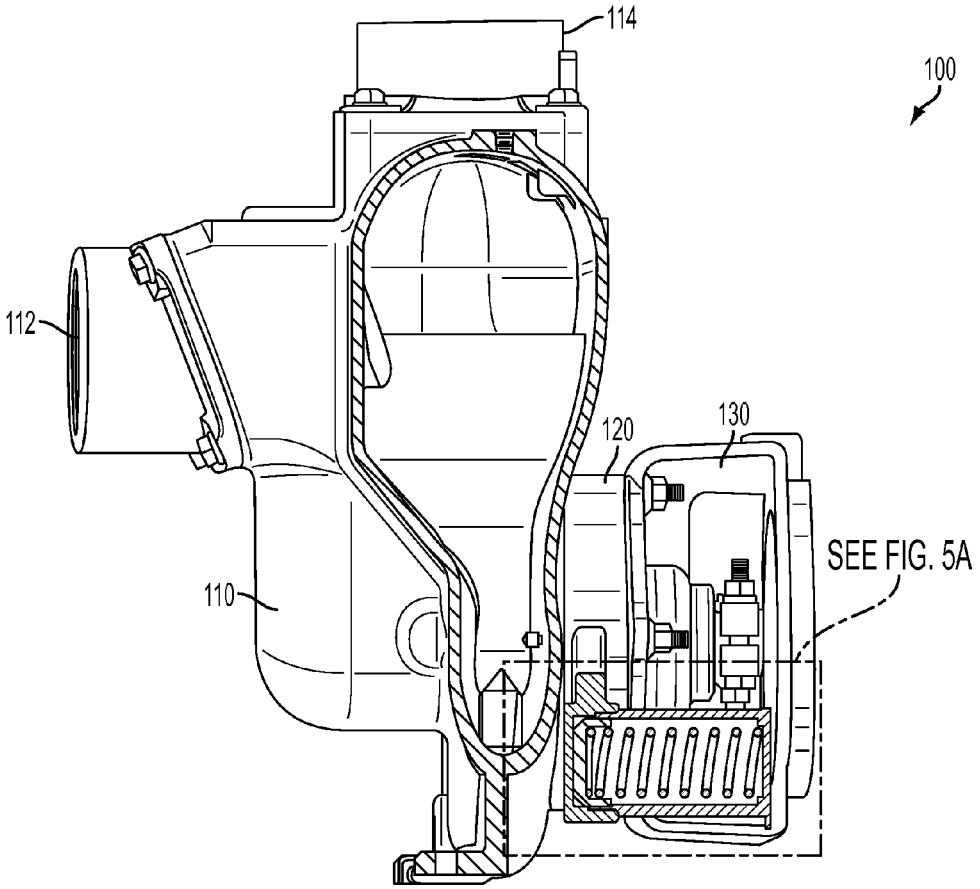
FIG. 5 is a cross section view of a double seal pump assembly in accordance with the present invention taken generally along line 5-5 in FIG. 1.
Figure 5A:
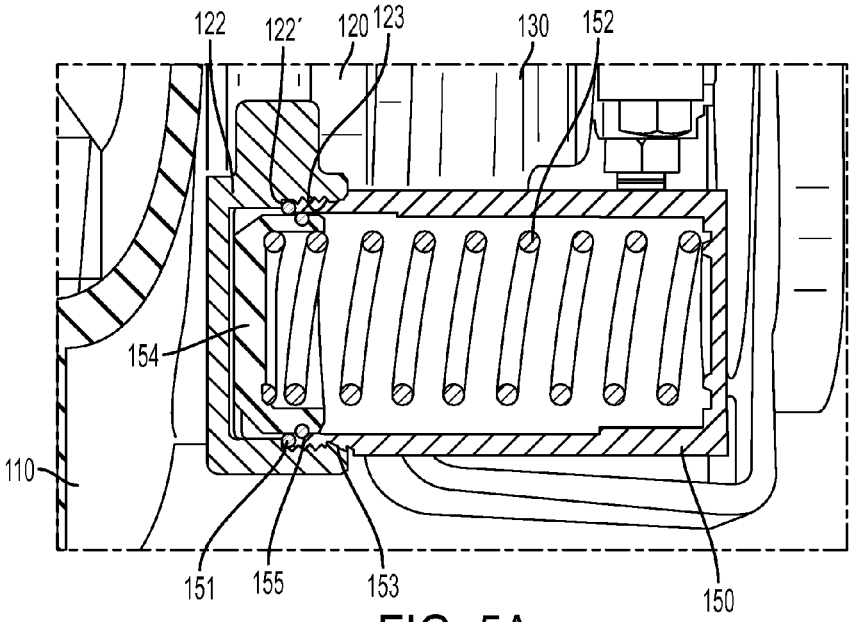
FIG. 5A is an expanded detailed view of an accumulator employed within the double seal pump assembly shown in FIG. 5.

As described earlier, present double seal pump systems utilize a dedicated external barrier fluid pump/delivery mechanism to deliver and maintain the barrier fluid within the pump seal cavity. These systems, however, are costly and are prone to an increased possibility of leaking of the barrier fluid due to the extra plumbing required to couple and operate these systems. The present invention addresses these and additional drawbacks by provision of an accumulator 150 integrally mounted to housing adapter 120. That is, rather than employ a cumbersome accumulator system having an external accumulator and dedicated supply and return lines, accumulator 150 is fixedly coupled to a lobe 122 situated on housing adapter 120 (see FIGS. 1-3 and 5-6). As seen most clearly in FIG. 6, lobe 122 includes a channel 128 so as to provide fluid communication between accumulator 150 and cavity 165 formed by the sealed union of housing adapter 120 and motor adapter 130. Accumulator 150 may be adapted to carry male threads 153 which matingly engage female threads 123 within lobe 122 so as to removably secure the accumulator 150 to the housing adapter 120. To ensure proper sealing between the accumulator and lobe, an O-ring 151 may seat along the leading edge of the accumulator and impact upon a ledge portion 122' of lobe 122 (see FIG. 5A).

To maintain cavity fluid pressure and provide make-up barrier fluid to cavity 165 when needed, accumulator 150 may be filled with a reserve barrier fluid. A piston 154 may reside within the internal chamber of the accumulator wherein the piston is actuated so as to drive reserve barrier fluid within the accumulator through channel 128 into cavity 165 should the need arise (i.e. should a leak develop within the cavity, such as through failure of seal assembly 160 as discussed above). Piston 154 may be actuated by an actuating force such as that provided by spring 152. Further, piston 154 may carry a piston seal ring 153 so as to provide a seal between the piston 154 and the inner wall of accumulator 150 such that reserve barrier fluid is prevented from leaking behind the piston when under pressure.

Thus, in operation, spring 152 exerts a force upon piston 154 to drive reserve barrier fluid into cavity 165 until such a point that the pressure within the cavity 165 equals the pressure exerted by the spring 152. Upon leak of a seal with the cavity, such as at seal assembly 160A or 160B, O-ring 131' or gasket 131" (see FIGS. 4 and 6), the pressure within cavity 165 is reduced below that of the accumulator pressure such that reserve barrier fluid is injected into the cavity upon actuated of the piston 154 by spring 152. Reserve barrier fluid is supplied until either the accumulator is emptied or until the leak is sealed thereby allowing stable re-pressurization of cavity 165.

In one aspect of the present invention, accumulator 150 may be constructed from a clear plastic material or may further include an indicator mechanism so as to enable a pump operator to determine the location of the leading edge of the piston 154 within the accumulator cylinder 150. Thus, in the case of a small leak and gradual depletion of reserve barrier fluid, the pump operator will be provided with some indication of such a leak before depletion of the reserve barrier fluid within the accumulator 150. This indication may be visual inspection of the accumulator by a pump operator or may be triggered by one or more sensors which detect the longitudinal travel or location of the piston 154 whereby the sensors emit or cause to be emitted a visual, audio and/or electronic signal/report advising an operator of the piston's location. Should the need arise, barrier fluid may be injected into cavity 165 by way of fitting 126 (see FIG. 2). Barrier fluid may be injected into the cavity 165 provided that the pressure of the gun or other delivery method is greater than the pressure of the fluid or the compression force of the spring within the accumulator 150. With sufficient pressure, barrier fluid may fill the cavity and displace fluid already located within the cavity through channel 128 into accumulator 150 by reverse translation of piston 154 and compression of spring 152. Barrier fluid may be injected into the cavity until an indication that the accumulator is at full capacity or until excess barrier fluid is ejected out of release valve 124.

Although the invention has been described with reference to preferred embodiments thereof, it is understood that various modifications may be made thereto without departing from the full spirit and scope of the invention as defined by the claims which follow.

What is claimed is:

1. A double seal pump assembly comprising:

a) a pump housing having an inlet and an outlet;

b) an impeller in communication with each of said inlet and said outlet wherein a fluid entering the inlet is pumped out of the outlet, the impeller including an integral impeller shaft extending outwardly from said housing and adapted to engage a drive shaft of a motor;

c) a housing adapter mounted onto said housing at a first seal, the housing adapter configured to secure said impeller to said housing, the housing adapter including a lobe having a channel defined therein;

d) a motor adapter mounted to said housing adapter at a second seal thereby defining a cavity therebetween, the motor adapter configured to mount the motor, wherein the cavity is configured to be charged with a barrier fluid through a zerk fitting; and e) an accumulator mounted onto said lobe and being in fluid communication with said cavity via said channel, the accumulator configured to hold a reserve barrier fluid, wherein the accumulator includes a piston biased to either deliver said reserve barrier fluid from said accumulator to said cavity or receive said reserve barrier fluid from said cavity to said accumulator when recharging said cavity via said zerk fitting so as to maintain barrier fluid volume and pressure within said cavity.

2. The double seal pump assembly of claim 1, wherein the accumulator is threadably mounted to said housing adapter.

3. The double seal pump assembly of claim 1, wherein the barrier fluid is a grease.

4. The double seal pump assembly of claim 1, wherein the housing adapter further includes a relief valve in communication with said cavity, the relief valve operable to prevent overcharging of the cavity.

5. The double seal pump assembly of claim 1, wherein the impeller shaft passes through respective holes within the housing adapter and motor adapter.

6. The double seal pump assembly of claim 5, further comprising an impeller shaft seal encircling a portion of said impeller shaft situated within said cavity so as to seal said respective holes and render said cavity substantially fluid-tight.

7. The double seal pump assembly of claim 1, wherein the first seal and the second seal are respective O-ring seals.

8. The double seal pump assembly of claim 1, wherein the piston is biased to deliver said reserve barrier fluid from said accumulator to said cavity via a spring.

9. The double seal pump assembly of claim 1, wherein the zerk fitting is mounted onto said housing adapter.

10. The double seal pump assembly of claim 1, wherein the accumulator is constructed from a clear plastic material configured to enable visual inspection of a fluid level of said reserve barrier fluid within said accumulator.

11. The double seal pump assembly of claim 1, wherein the accumulator remains mounted to said lobe when said cavity is being recharged via said zerk fitting.

12. A double seal pump assembly comprising:

a) a pump housing having an inlet and an outlet;

b) a housing adapter mounted onto said housing at a first seal, the housing adapter including a lobe having a channel defined therein;

c) a motor adapter mounted to said housing adapter at a second seal thereby defining a cavity therebetween, the motor adapter configured to mount the motor, wherein the cavity is configured to be charged with a barrier fluid through a zerk fitting;

d) an impeller secured to said housing and in communication with each of said inlet and said outlet wherein a fluid entering the inlet is pumped out of the outlet, the impeller including an integral impeller shaft extending outwardly from said housing and adapted to engage a drive shaft of a motor, the impeller shaft passing through respective holes within the housing adapter and motor adapter;

e) an impeller shaft seal encircling a portion of said impeller shaft situated within said cavity so as to seal said respective holes and render said cavity substantially fluid-tight; and f) an accumulator mounted to said lobe and in fluid communication with said cavity via said channel, the accumulator configured to hold a reserve barrier fluid, wherein the accumulator includes a piston biased to either deliver said reserve barrier fluid from said accumulator to said cavity or receive said reserve barrier fluid from said cavity to said accumulator when recharging said cavity via said zerk fitting so as to maintain barrier fluid volume and pressure within said cavity.

13. The double seal pump assembly of claim 12, wherein the barrier fluid is a grease.

14. The double seal pump assembly of claim 12, wherein the housing adapter further includes a relief valve in communication with said cavity, the relief valve operable to prevent overcharging of the cavity.

15. The double seal pump assembly of claim 12, wherein the first seal and the second seal are respective O-ring seals.

16. The double seal pump assembly of claim 12, wherein the piston is biased to deliver said reserve barrier fluid from said accumulator to said cavity via a spring.

17. The double seal pump assembly of claim 12, wherein the zerk fitting is mounted onto said housing adapter.

18. The double seal pump assembly of claim 12, wherein the accumulator is constructed from a clear plastic material configured to enable visual inspection of a fluid level of said reserve barrier fluid within said accumulator.

19. The double seal pump assembly of claim 12, wherein the accumulator remains mounted to said lobe when said cavity is being recharged via said zerk fitting.

* * * * *